United States Patent [19]

Lee

[11] 4,385,546

[45] May 31, 1983

[54] CARTRIDGE RELOADING DIES

[76] Inventor: Richard J. Lee, 3146 Kettle Moraine Rd., Hartford, Wis. 53027

[21] Appl. No.: 310,558

[22] Filed: Oct. 13, 1981

[51] Int. Cl.[3] ..... F42B 33/10

[52] U.S. Cl. ..... 86/36; 86/23; 86/43

[58] Field of Search ..... 86/23, 25, 28, 36, 37, 86/43

[56] References Cited

U.S. PATENT DOCUMENTS

| | | | |
|---|---|---|---|
| 180,693 | 8/1876 | Wolcott | 86/36 |
| 3,750,528 | 8/1973 | Boddie | 86/36 X |
| 4,189,980 | 2/1980 | Schaenzer | 86/43 X |
| 4,336,739 | 6/1982 | Alexander | 86/43 |

*Primary Examiner*—Leland A. Sebastian

*Attorney, Agent, or Firm*—Wheeler, House, Fuller & Hohenfeldt

[57] ABSTRACT

An ammunition casing reloader die set. The sizer and decapping die employs a decapping rod that is frictionally held in the die body with a collet so it can yield without damage. The decapping pin is press fitted in the rod. The bullet seater die is provided with a capped adjusting screw in which the bullet seater element floats so it adjusts itself into alignment when a bullet on a casing is rammed into it.

11 Claims, 6 Drawing Figures

CARTRIDGE RELOADING DIES

BACKGROUND OF THE INVENTION

This invention relates to dies that are used in presses for reloading ammunition cartridges.

Dies for reloading ammunition cartridges (hereafter called casings) are customarily screwed into a turret of any of a variety of commercially available reloading presses. A sizing and decapping die is rotatable with the turret selectively into alignment with a lever-driven ram which drives the casing into the sizing and decapping die. After the casing is recapped and refilled with powder, the turret is rotated to align the bullet seater die with the ram and the bullet seating operation is performed.

Insofar as prior art sizing and decapping die assemblies are concerned, the weakest and most frequently failing part is the decapper and the rod to which it is attached. Ordinarily, this rod is threaded into the internal thread of a nut, adjusted and locked into place with a jamb nut. This assembly is then threaded into the sizing die in alignment with its axially extending casing receiving bore. If the rod is misadjusted when assembled or becomes misadjusted through use, it is quite vulnerable to being damaged. This occurs because, during the time that maximum pressure is applied to size the casing, the operator will not feel the slight additional resistance to ram movement that the misadjusted rod causes.

The lower end of the decapping rod is customarily provided with a decapping pin which drives the spent cap or primer out of the rim of the casing at about the time that the casing reaches its limiting position in the sizing die. In accordance with prior practice, the decapping pin is threaded into an end of the decapping rod or into an adapter that is threaded on the rod. This approach requires multiple machining steps, one being to cut an external thread on the small diameter decapping pin and another to tap a thread in the small hole in the end of the decapping rod that receives the pin. More often than not, a slight misalignment results between the axes of the threaded hole and decapping pin so the pin is often slightly out of alignment and angulated with respect to the axis of the rod. Threads also weaken the pin. The result has been frequent breakage of the pin. In fact, breakage of these prior art decapping assemblies is expected to be and is so frequent that the pins are considered expendable and means are provided by the manufacturer for replacing them. This means that the user is obliged to acquire more parts and yet not resolve the problem of thread misalignment.

Prior art bullet seating dies are also problematical. The bullet-seater is customarily a cylindrical body that has an external thread for screwing it into the turret. It is adjusted in or out on the thread so that the contoured surface inside of the seater bore that pushes on the nose of the bullet to seat it to the proper depth in the casing is centered on a threaded shank. The accuracy of this construction is dependent upon the accuracy of the machining of the threads. Because the threaded end of the bullet seating die is at the extreme opposite end of the die that the casing is inserted into, it necessitates two different threading machine operations. Machinists are aware that it is impossible to obtain perfect alignment between two threaded parts. With the tolerances found in commercial production machines, it is quite possible to have a misalignment of 1/64 inch or more.

SUMMARY OF THE INVENTION

In accordance with the invention, the aforementioned problems experienced with prior art sizing dies are solved in two ways. First, the decapping pin is made of hard and heat-treated steel such as type 52100 steel and is press-fitted into a solid and unthreaded decapping rod. This in itself makes a stronger assembly than the prior art threaded arrangement. Second, the decapping die is provided with a collet element which frictionally clamps the decapping rod centrally with the sizing die body. If, the pressure would happen to exceed the limit normally required to decap or drive the primer out of a casing, the rod merely slips or yields axially through the collet so as to relieve the excess pressure and avoid damage.

A benefit of employing the collet type clamping element is that if a casing jams in the sizing die and strips the rim of the casing so that it cannot be extracted by the reloader press ram in the usual way, all the user has to do to remedy the situation is loosen the collet and drive on the upper end of the decapper rod to thereby remove the stuck casing.

In accordance with another feature of the invention, the aforementioned problems experienced with prior art bullet seating dies are also reduced substantially. In the new die the bullet-seater element is allowed to float in the smooth axially extending hole in an adjusting screw that is closed at one end to provide a stop for the element and has an external thread for turning it into the die body with finger pressure. The bullet seater screw is adjustable by turning it in or out which provides for setting the location at which the floating seater element is stopped so that the bullet will always be pressed into the casing to the proper depth. In addition, the bullet seater screw is held in its adjusted position with an o-ring that surrounds its threads and imposes friction on the threads.

How the foregoing and other unique features of the invention are implemented will be evident in the more detailed description of a preferred embodiment of the invention which will now be set forth in reference to the drawing.

DESCRIPTION OF A PREFERRED EMBODIMENT

Figure 4:
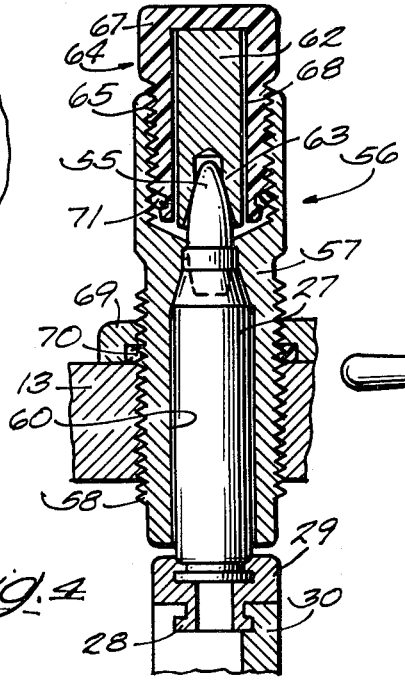
FIG. 4 is similar to FIG. 3 except that it shows the bullet in the stage of having been seated by the seater element in the die.
Figure 5:
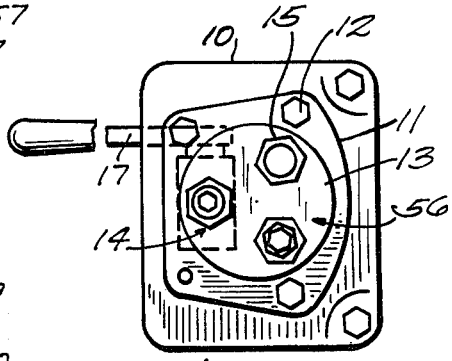
FIG. 5 is a top view of an ammunition casing reloading press.

The single view of a reloading press shown in FIG. 5 is provided for illustrating an environment in which the new sizing and decapping die and bullet seater die may be used. The press comprises a base 10 over which a plate member 11 is mounted on some posts, not visible, to which the plate is fastened by means of machine screws such as the one marked 12. A turret 13 is manually rotatable in plate 11 about an axis that is perpendicular to the plane of the drawing. There are three dies installed in the turret. The die marked 14 is presently in the active position and may be the sizing and decapping die 14 depicted in FIG. 1. Another element 15 may be used to funnel powder into a casing when this element is rotated to active position. A die 56 in the turret may be the bullet seater die depicted in FIGS. 3 and 4. The reloader press is provided with a manual operating lever 17 for driving a ram, not visible in FIG. 5, along a line perpendicular to the plane of the drawing for advancing and retracting an ammunition casing that is to be reloaded toward and away from the elements on the turret. An ammunition reloading press in which the decapping and sizing die and the bullet seater die constituting the present invention may be used, is shown in a co-pending application of the present applicant, Ser. No. 280,677, Filed July 6, 1981.

Figure 1:
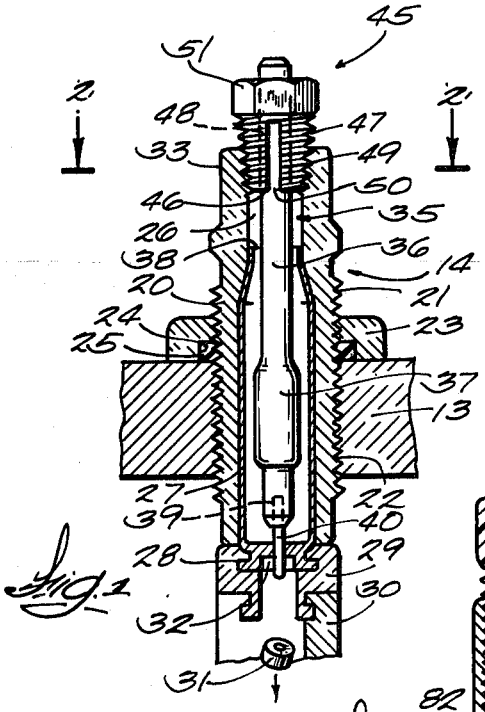
FIG. 1 is a longitudinal section through an ammunition casing sizing and decapping die installed in a fragmentarily shown part of a reloading press together with a part of the ram of the press that advances and retracts the casing from the die.
Figure 2:
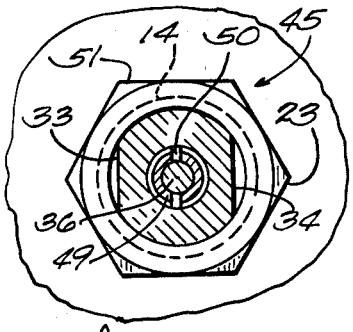
FIG. 2 is a transverse section taken on a line corresponding with 2—2 in FIG. 1.

The new sizing and decapping die will now be described in reference to FIGS. 1 and 2. In FIG. 1, die 14 comprises a generally cylindrical body 20 that has an external thread 21 for permitting it to be screwed into an internal thread 22 in the turret 13 or other anchored part of a casing reloading press. The body has its sides 33 and 34 milled flat to permit it to be engaged by a wrench. Instead of using the usual split knurled nut and set screw to lock the die against inadvertent turning on its threads in the turret, the die in FIG. 1 is locked with a nut 23 that has a counterbore 24 in which a pliable o-ring 25 is disposed. When nut 23 is screwed tight onto the die and is pressed against the top of turret 13, o-ring 25 is deformed compressively into the external threads 21 of the die to effect friction locking of nut 23 and the die body. Sizing die 14 has an internal shape and size to the exterior of a cartridge casing such as the one marked 27 which has been forced into the die.

Typically, the casing has a rim 28 which, as shown, is engaged by a holder 29 that is fastened to the end of a vertically movable reloading press ram 30. The ram can be moved up and down to push the casing into the die bore and to retract it from the die bore adter it has been sized. In FIG. 1, a spent cap or primer 31 is shown falling away from casing 27 after having been driven out of cap recess 32 in the rim of the casing.

The sizing and decapping die 14 in FIG. 1 features a unique arrangement for holding a decapping rod that is designated generally by the numeral 35. The decapping rod has a uniform diameter portion 36 and a larger diameter portion 37. The diameter of portion 37 is such that when the casing 27 is pushed into the die while the rod 35 is held, the enlarged diameter portion 37 will round the mouth 38 of the casing if it has been deformed so a bullet can be inserted.

The lower end of decapping rod 35 has a counterbore 39 in which a decapping pin 40 is pressed. The absence of any threads on the pin 40 and counterbore 39 makes it easier to establish the pin coaxially and without angulation relative to the axis of rod 35.

As indicated earlier, it has been customary to provide the decapping rod with an external thread for screwing it into the die body and adjusting it to what is supposed to be the proper axial position for driving the cap 31 out of the casing rim without having the driven casing apply undue force to the rod. The external thread on the prior art rod also provided for applying a jamb nut to the rod so it could not possibly yield axially if subjected to overstress at the last part by the die. Because of the high mechanical advantage in the lever system, not shown, that drives the ram, the operator usually cannot feel the additional resistance that may be contributed by the decapping rod being misadjusted or misaligned. These conditions often caused the decapping pin or rod to be bent and damaged to the extent it had to be discarded.

In accordance with the invention, means are provided for holding the decapping rod assembly 35 securely enough for it to perform its sizing and decapping functions but not so securely that it cannot yield to relieve undue stresses if it is misadjusted. Thus, as can be seen in FIG. 1, the rod is held in a clamping element 45, similar to a collet, that frictionally engages the long cylindrical portion 36 of the rod. Clamping element 45 is comprised of a body portion 46 that has an external thread 47 and an axial bore 48. Threaded portion 47 is tapered so it will fit tighter and tighter as it is screwed into internal thread 49 in the die body 14. The threaded portion of the clamping element has a diametrical slot 50 as can be seen in FIGS. 1 and 2. The slot allows the threaded part of the clamping element to flex inwardly and impose a frictional gripping force on the decapping rod portion 36 when the tapered thread is screwed into the die body. A hexagon part 51 provides for screwing the clamping element into the die body with a wrench. The arrangement makes it easy to adjust the decapping rod assembly 35 to the proper position in the die 14. More importantly, it allows for the frictional gripping force to be overcome such that the rod assembly 35 can yield axially before it is damaged if it has been misadjusted.

After the spent casing has been decapped as is the case in FIG. 1, a new cap or primer is inserted in the cap recess 32 of the casing by means which are illustrated in the cited application, for example, and the casing is subsequently filled with powder. It is then ready to have a bullet inserted in it as with the new bullet seater depicted in FIGS. 3 and 4 which will now be discussed.

Figure 3:
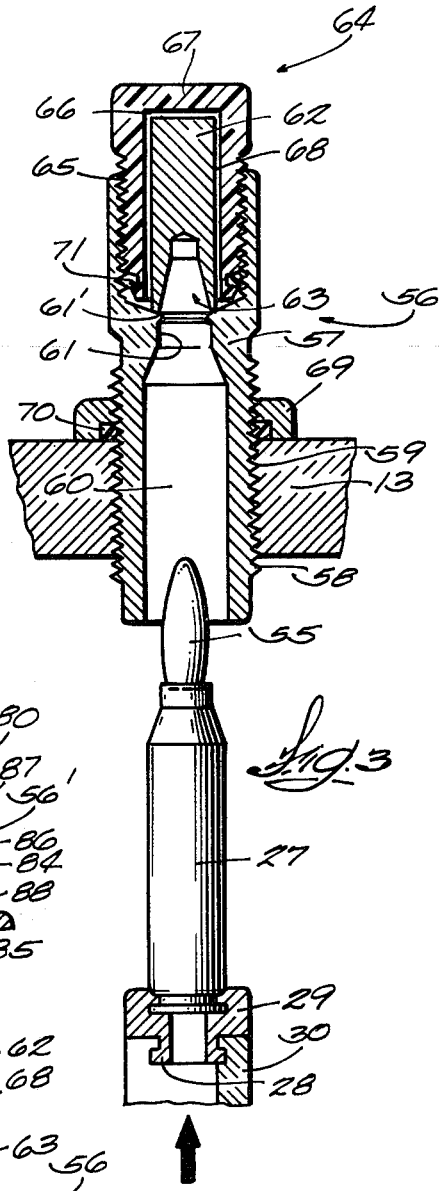
FIG. 3 is a longitudinal section of a bullet seater die installed in a fragmentarily shown part of a reloader press in conjunction with a casing in which a bullet has been inserted and which is aligned for being pushed into the reseater die by means of the fragmentarily shown part of the ram on which the casing is mounted.

FIG. 3 shows a casing 27 on which a bullet 55 has been deposited for being seated in the casing. The casing is on the ram 30 and aligned with the bullet seater that is generally designated by the numeral 56. The bullet seater 56 comprises a generally cylindrical body 57 that has an external thread 58 for permitting it to be screwed into an internal thread 59 in part 13 of the reloading press. Body 57 has a bore 60 in whose upper end there is a reduced diameter portion 61 that allows clearance around the mouth of the casing so it can expand when the bullet 55 is pressed into the casing by driving it into the seater body with the ram. At the top of reduced diameter portion 61 there is a small radially inwardly extending conical shoulder 61′ which turns in the casing mouth edge a small amount to crimp the bullet 55. Seater assembly 56 accommodates a cylindrical bullet seater element or punch 62 whose one end has a conical counterbore 63 which is for engaging and aligning the bullet 55 and for pressing the bullet into the casing when the bullet is undergoing the seating operation. Customarily, the seater element has been mounted to an externally threaded shank that is screwed coaxially into the seater body and locked with a jamb nut. As indicated earlier, it has been very difficult to machine with such accuracy as to obtain perfect axial alignment between the threaded parts especially where the seater element is threaded onto one end of the shank and the remotely spaced other end of the shank threads into the seater body. In accordance with the invention, the seater element 62 is adapted to float to align itself with the bullet. This is done by capturing it in an adjusting screw means comprised of a tubular element that is generally designated by the numeral 64 in FIGS. 3 and 4. The adjusting screw has an external thread 65 for screwing it into an internal thread in body 56. The screw has a smooth axially extending central hole 66 which is closed by the top wall 67 of the adjusting screw which wall serves as a stop for seater element 62. Instead of being closed-ended, the tubular adjusting screw could have a diametrally extending pin or shoulder means, not shown, to serve as a stop. The outside diameter of element 62 is slightly less than the inside diameter of axial hole 66 in which case a small annular gap 68 is formed around seater element 62. The hole 66 in adjusting screw means 64 is presented toward the bore 60 in the die body 57. In a commercial embodiment, by way of example and not limitation, in a case where the outside diameter of the seater element 62 is 0.36 inch and the diameter of hole 66 is 0.375 inch so there is an opportunity for the element 62 to shift laterally as much as 0.015 inch to obtain alignment with the bullet. In seater assemblies for other sized bullets, the dimensions are different, of course.

The adjusting screw means 64 is provided at the end of its external thread with an annular groove in which there is an o-ring 71 that wedges into the internal thread in the body to create friction for holding the adjusting screw 64 in whatever position it has been turned by hand. In FIG. 3, there is a gap between the top of element 62 and the end closing portion 67 of the screw which gap exists before the bullet is rammed into the body 56 for being pressed into the conical recess 63 of floating seater element 62. FIG. 4 shows how seater element 62 finally comes to a stop against end wall 67 for producing the reactive force that presses the bullet 55 into casing 27 when the casing is rammed into the die body. If there is misalignment, the seater element 62 just shifts laterally toward one side or the other of gap 68 under the influence of the mating tapers of the bullet nose and conical bore 63 to align the axis of element 62 with that of the bullet. Thus, deforming the bullet or angulating it with respect to the casing, which frequently happened with conventional non-floating seater elements, is avoided.

In a commercial embodiment, adjusting screw 64 is molded of a ough resin, for example, 30% glass fiber filled nylon.

Note in FIGS. 3 and 4 that the seater body 57 is secured in reloader press part 13 with a lock nut 69 which is counterbored for containing an o-ring 70 for wedging into the external thread 58 of the body to prevent the latter from turning inadvertently as previously explained in reference to nut 23 in FIG. 1.

Figure 6:
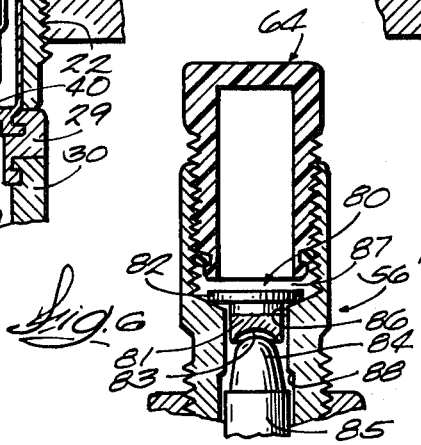
FIG. 6 is an alternative bullet seater die, shown in longitudinal section, which implements the new floating seater element concept.

FIG. 6 shows an alternative form of the bullet seater die which also implements the floating seater element concept. This embodiment is adapted for seating bullets in short casings such as are used in pistols.

In FIG. 6 the adjusting screw 64 is shown as being identical with the similarly identified screw in the FIG. 3 and 4 embodiment. Other similar parts are identified with the same reference numerals.

In FIG. 6, the floating seater element is identified by the numeral 80. It has a cylindrical shank 81 and an integral flange 82. The end of shank 81 has a curved recess or concavity 83 into which the rounded tip of the bullet 84 registers when the casing 85 is rammed into the die body 56'. The bore portion 86 in the die has an inside diameter a little greater than the outside diameter of the seater element shank 81 so the element can shift laterally to effect self alignment with the axis of bullet 84 under the influence of the rounded nose of the bullet entering concavity 83. The adjusting screw 64 is screwed into the die body 56' only so far as to allow a free space 87 between the top of seater element flange 82 and the lower end of adjusting screw 64. Hence, the seater element can move axially but will stop against the adjusting screw when casing 84 is rammed into the die far enough and the bullet will thereby be set in the casing. The screw is adjusted such that, substantially coincident with the seater element coming to a stop, the edge of the casing mouth will encounter a small conical shoulder 88 that crimps the casing to the bullet.

Although illustrative embodiments of the combination sizer and decapper and the bullet seater have been described in detail, such description is intended to be illustrative rather than limiting, for the invention may be variously embodied and is to be limited only by interpretation of the claims which follow.

I claim:

1. A device for use in ammunition casing reloading apparatus comprising:

a body having a bore for receiving a casing, a decapper rod for being held in the bore coaxially therewith, said rod having a pin extending from one end for driving a cap from a casing when said casing is forced a sufficient distance into the bore, clamping means having means for fixedly engaging with said body and for frictionally gripping said rod in a region remote from said pin such that if more than a predetermined force is imposed on said rod by said casing said rod will slip to avoid being damaged.

2. The device defined in claim 1 wherein said rod has an unthreaded hole in said one end coincident with the axis of the rod and said pin is unthreaded and tightly fit into the hole to be coaxial with said rod.

3. The device as in any of claims 1 or 2 wherein said body is generally cylindrical and has an external thread for screwing it into said reloading apparatus, a locknut having a thread for turning it onto the thread of said cylindrical body, said locknut having a counterbore coaxial with its thread, and an o-ring disposed in said counterbore for being deformed into said threads when said locknut is tightened, to thereby prevent said body from turning in said reloading apparatus.

4. A device for use in ammunition casing reloading apparatus, comprising:

a generally cylindrical body having an external thread for being screwed into reloading apparatus and having an axial bore for admitting a casing coaxially into one end of the bore, a decapper rod for being held in the bore coaxially therewith, said rod having a pin extending from one end for driving a cap from a casing when said casing is forced a sufficient distance into the bore, said body having an internal axially extending thread in the other end of said bore opposite from said one end, a clamping element having an axial hole for said rod to extend through it and having an axially extending external thread on at least a portion thereof for permitting it to be screwed into said internal thread in said other end, said clamping element having an axially extending slot for permitting said portion to flex radially inwardly to grip said rod frictionally when said element is screwed into said body.

5. The device defined in claim 4 wherein said rod has an unthreaded hole in said one end coincident with the axis of the rod and said pin is unthreaded and tightly fit into the hole to be coaxial with said rod.

6. The device as in any of claims 4 or 5 wherein said body is generally cylindrical and has an external thread for screwing it into said reloading apparatus, a locknut having a thread for turning it onto the thread of said cylindrical body, said locknut having a counterbore coaxial with its thread, and an o-ring disposed in said counterbore for being deformed into said threads when said locknut is tightened, to thereby prevent said body from turning in said reloading apparatus.

7. A bullet seater die for use in ammunition casing reloading apparatus, comprising:

a die having a bore into whose one end a casing having a bullet thereon may be forced incidental to performing a bullet seating operation, an externally threaded adjusting screw means for screwing into said body coaxially to said bore, a bullet seater element arranged in said die for moving axially and shifting laterally by a small amount, said element having a recess in an end thereof that is presented toward said one end of the bore, said recess being shaped such that it will cause said element to shift laterally to align said element with said bullet when a bullet on a casing is advanced into the bore, said element being adapted to shift axially and be stopped by said screw means to thereby seat said bullet in the casing.

8. A bullet seater die for use in ammunition casing reloading apparatus, comprising:

a die body having a bore into which a casing having a bullet extending from it may be forced incidental to performing a bullet seating operation, an externally threaded adjusting screw means for screwing into said body, said adjusting screw having a cylindrical hole of predetermined diameter opening at one end toward said bore and coaxial with said bore, and a bullet seater element disposed in the hole of said screw means, said element having a recess in an end presented toward said bore for a bullet that is to be seated to register therein, the diameter of said element being slightly less than the diameter of said hole to enable said seater element to float in said hole for aligning with said bullet.

9. A device for use in ammunition casing reloading apparatus to seat a bullet in a casing, comprising:

a body having a bore for receiving a casing that has a bullet extending from it and having a threaded opening coaxial with the bore, adjusting screw means having an axially extending external thread for screwing it into said opening, said screw means having an axially extending hole of predetermined diameter opening toward said bore and stop means remote from the opening, and a bullet seater element disposed in the adjusting screw means hole, said seater element having a recess in an end that is presented toward said bore into which recess the nose of said bullet registers for being seated in said casing when said casing is forced into said bore, said seater element having a diameter slightly less than said hole so it can shift to align with said bullet before said element is stopped by said stop means.

10. The device defined in claim 8 wherein said adjusting screw means is provided with an annular groove adjacent its thread and there is an o-ring in said groove for frictionally engaging said thread in said opening to maintain said screw means in adjusted position.

11. A bullet seater die for use in ammunition casing reloading apparatus, comprising:

a die body having a bore into whose one end a casing having a bullet extending from it may be forced incidental to performing a bullet seating operation, a bullet seater element disposed in said die body, said element having a cylindrical portion substantially coaxial with said bore and sized to permit said portion to shift laterally relative to the axis of the bore, said cylindrical portion having a flange at one end and having a recess in an end that is presented toward said one end of the bore, said recess being shaped such that it will cause said element to shift laterally to align itself with said bullet when entered by the nose of a bullet on a casing that is being advanced into the bore, externally threaded adjusting screw means for being screwed into said body coaxially to said bore and in spaced relation relative to said flange on the cylindrical portion of said seater element for allowing said element to move axially and for said adjusting screw means to stop said axial movement to thereby seat said bullet in said casing.

* * * * *